United States Patent [19]

Perretta

[11] 4,000,695

[45] Jan. 4, 1977

[54] INK FOUNTAIN BLADE ASSEMBLY

[76] Inventor: Frank Perretta, Aux. Rte. 2, Marlboro, N.Y. 12542

[22] Filed: Oct. 16, 1975

[21] Appl. No.: 622,871

[52] U.S. Cl. ..... 101/365

[51] Int. Cl.[2] ..... B41F 31/02

[58] Field of Search ..... 101/365, 167–169

[56] References Cited

UNITED STATES PATENTS

| | | | |
|---|---|---|---|
| 367,526 | 8/1887 | Jaeck | 101/365 |
| 1,275,348 | 8/1918 | Wood | 101/365 |
| 3,559,573 | 2/1971 | Hantscho | 101/365 |

*Primary Examiner*—Edgar S. Burr
*Assistant Examiner*—A. Heinz
*Attorney, Agent, or Firm*—Joseph L. Spiegel

[57] ABSTRACT

An ink fountain blade assembly is mounted in a printing press of the lithographic and letter press variety for regulating the flow of ink onto a roller. The assembly is self contained and is readily removable and may be disassembled for cleaning or maintenance. The assembly has two parallel plates with a plurality of ink blades slidably mounted between the plates. The ends of the blades project beyond the plates and are engageable with the roller. Selectively actuable elements allow each blade to be individually adjusted relative to the roller.

5 Claims, 2 Drawing Figures

INK FOUNTAIN BLADE ASSEMBLY

FIELD OF THE INVENTION

This invention relates to improvements in ink fountains of printing presses and, in particular, to an ink fountain blade assembly having a plurality of ink blades for controlling the flow of ink onto a roller.

BACKGROUND OF THE INVENTION

In a printing press of the lithographic and letter press variety, it is customary to have an ink fountain in which the rate of application of ink to a roller is controlled so as to result in a uniform application of ink during printing. Prior art ink fountains have included numerous forms of segmented type ink blades that are individually adjustable so as to control the rate of application of ink to the fountain roller. Examples are shown in U.S. Pat. Nos. 367,526—Jaeck; 984,913—Hayes; 2,583,640—Faeber; 3,623,430—Lessun; and, 3,779,165—Abendroth, et al. These examples are typical of the prior art and are not intended to represent all of the prior art. However, as far as is known, ink fountains of the prior art are disadvantageous in several aspects which the present invention is designed to overcome.

First, most are made of separate parts that are assembled in place in the press. In contrast, the instant invention comprises an assembly of parts that are movable together and are mounted as a unit in a press. Moreover, the use of an assembly permits different sized and shaped ones to be made to fit different presses and yet allows many common parts to be used in the various assemblies.

Second, many of the prior art devices are difficult to clean and maintain. By use of the assembly arrangement of the invention, the moving parts are protected from contamination except for the exposed ends of the ink blades. For maintenance, the assembly includes a plate that can be readily removed while the assembly is in place in the press, to provide access to the inner parts.

SUMMARY OF THE INVENTION

In view of the foregoing, one of the objects of the invention is to provide an ink fountain blade assembly that is self contained, adjustable, and easy to maintain and clean.

Another object is to provide an ink fountain blade assembly having a positive action (without the use of springs) between the ink blades and roller.

A further object is to provide an ink fountain blade arrangement having a plurality of adjustable blades that are in close proximity to each other to minimize the flow of ink therebetween.

Still another object is to provide a blade assembly wherein the ends of the blades contacting the ink roller are shaped to conform to the curvature of the roller so as to allow a smooth flow of ink while maintaining the curvature of the roller as wear occurs.

Other objects and advantages of the invention will be apparent from the following detailed description and the accompanying drawing wherein:

FIG. 1 is a side elevational view of a portion of a press having mounted therein the improved ink fountain assembly of the invention; and, FIG. 2 is a view, partly in section and with portions broken away, looking along reference line 2—2 of FIG. 1.

DETAILED DESCRIPTION

Figure 1:
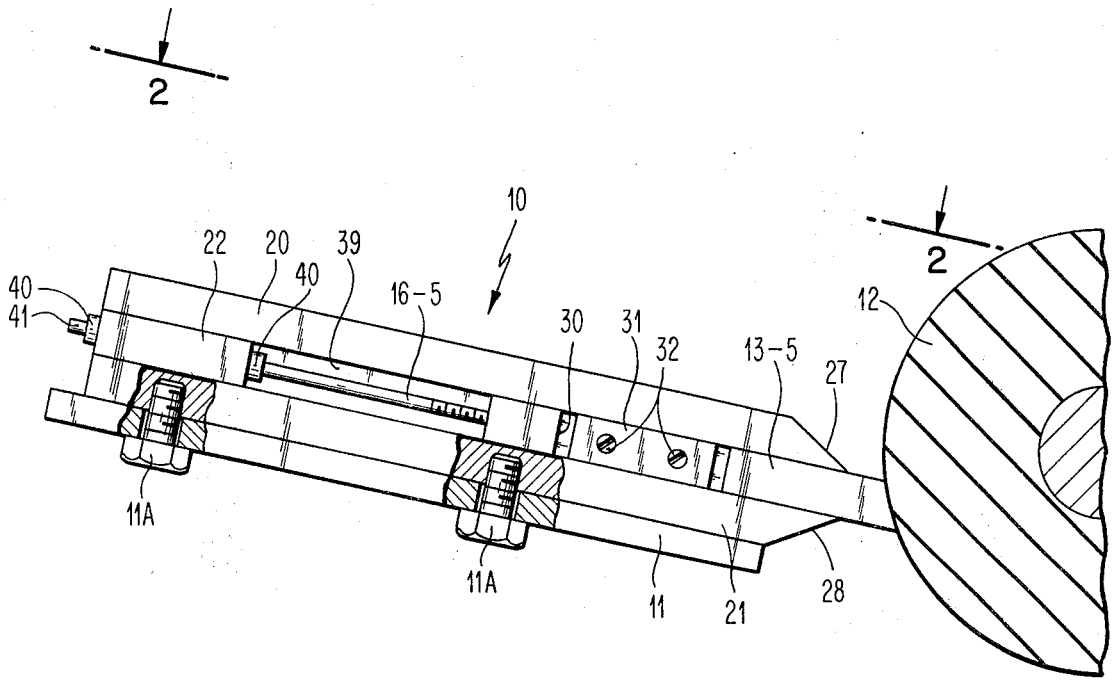
Figure 2:
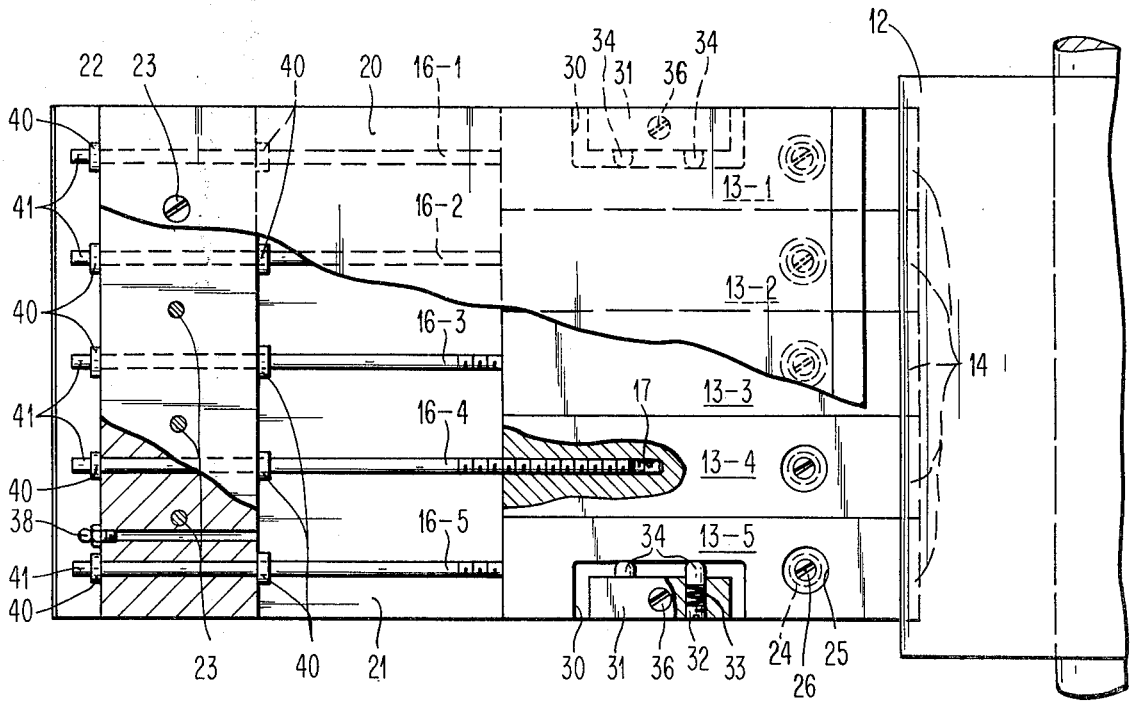

Referring now to the drawing, an ink fountain assembly 10 is mounted on the stationary bed 11 of a printing press of the lithographic and letter press variety, adjacent to an ink roller 12 with the ends of blades 13 of the assembly in contact with the roller. The press and roller are conventional and the way in which assembly 10 is mounted is conventional, such as by means of clamps, bolts, etc. that are normally used in the press or, as is shown in the illustrated example, by means of securing bolts 11A threaded through and into openings and bores in the bed 11 and base of assembly 10, respectively. The original bolt holes in bed 11 can be used. No modification to the press is required. The blades are of equal width and are located laterally adjacent each other. The combined total widths of the blades are equal to the width of the roller or the area thereof over which the ink will be spread. As shown in FIG. 2, there are five non-flexible blades, as of stainless steel blades 13-1–13-5 and it should be obvious that fewer or more blades can be used dependent primarily on the length of the roller. It is preferable to limit the width of the blades to roughly 1 inch to 1¼ inch so that each one regulates the flow of ink over a relatively small area.

Each blade 13 has an arcuate end or edge 14 that conforms the roller circumference and has substantially the same radius. This allows a smooth flow of ink. Additionally, the blade should wear evenly so as to maintain the same curvature. Each blade has the shape of an elongated block with parallel side surfaces. An exemplary size is 5 inches × ⅜ inch × 1¼ inch. The ends of the blades opposite surfaces 14 are connected to threaded rods 16-1–16-5. To do this, each blade has a threaded bore 17 (shown only for blade 13-4) which receives the threaded end of the connected rod 16.

Assembly 10 further includes upper and lower parallel, rectangular plates 20 and 21. A spacer bar 22 is connected by bolts 23 to plates 20 and 21 and extends along one edge of the assembly opposite to the end with blades 13. A plurality of annular spacer rings 24 extend through holes or apertures 25 in blades 13 and are connected to plates 20 and 21 by bolts 26. Holes 25 are larger than rings 24 to allow sufficient movement of the blades. Rings 24 and bar 22 hold plates 20 and 21 in a rigid parallel relationship and the distance between the plates, as determined by the thicknesses of the rings and bar, is slightly greater than the thickness of each blade so that the blades are slidable therebetween. The edges of the plates along blades 13 are beveled or sharpened at 27 and 28 and serve to wipe the blades and limit the flow of ink into the assembly.

Side blades 13-1 and 13-5 are each recessed at 30 and encompass a block 31 containing two bores each of which contains a set screw 32, a spring 33 and a pin 34 pressed against the side of the blade. Blocks 31 are attached by bolts 36 to plates 20 and 21 so that pins 34 bias or press blades laterally against each other.

Assembly 10 further includes one or more grease fittings (in the illustrated example one is shown and designated 38) which lead grease into the cavity 39 where rods 16 are located. The grease serves to lubricate the sliding blade segments 13 and prevents ink from the fountain going under plates 20 and 21 and drying up above, below and in between blade segments.

The cavity 39 in between bar 22 and blades 13 where rods 16 are located is formed by upper and lower plates 20, 21 and abutting side walls of the press within which assembly 10 is located.

Each of rods 16 passes through bar 22 and is connected to two collars 40 that straddle the bar so as to allow rotation of the rod without any longitudinal movement. The ends 41 of rods 16 are exposed and are shaped so as to be grasped manually either with or without the use of a tool, so that the rods can be rotated. Rotation may be accomplished manually or by means of motors. Dependent on the direction of rotation of rods 16, the blades 13 can be moved towards or away from roller 12 thereby to regulate the flow of ink onto the roller. Ends 41 may be connected to some form of scale or indicator that indicates the position or adjustment of each blade. It should be noted that there is a positive action, without the use of springs. The absence of springs permits easier rotation of rods 16.

The removal of bolts 23 and 26 allows upper plate 20 to be removed so as to expose the inner parts of the assembly for cleaning and maintenance purposes.

In summary, of particular importance with the blade assembly of the present invention is that it can replace any standard blade assembly on any press of the lithographic or letter press variety without any modification to the existing fountain roller or castings. The assembly of the present invention can be slipped into place and be bolted to the bed or frame using the original bolts from the previous blade assembly. Action is positive and there are no springs. No complicated or precision machinery is required to keep the blade segments in close proximity. Ink is prevented from leaking in between segments. The curvature of the ends of the blade segments matches that of the roller allowing smoother flow of ink than a knife edge would. If any wear occurs at the tips, the tips still retain the original curvature of the fountain roller.

All moving parts of the assembly are protected from comtamination. For maintenance, upper plate 20 is unbolted and removed revealing all the working parts without removing the entire assembly from the press. For cleaning, the assembly blades can be tilted back in the normal manner and is cleaned. There are no obstructions from underneath.

It should be obvious that changes, additions and omissions may be made in the details and arrangement of parts without departing from the scope of the invention as defined in the appended claims.

What is claimed is:

1. An ink fountain blade assembly adapted to be detachably mounted in a printing press for regulating the flow of ink onto a roller, said assembly having a generally flat rectangular shape and being bounded by flat parallel rectangular upper and lower surfaces, front and back edges and lateral sides, said assembly comprising:

first and second flat, rigid rectangular plates forming said upper and lower surface having forward and rearward edges;

a spacer bar fixedly attached between said plates along said plate rearward edges running along said back edge of said assembly and spacing said plates in a parallel relationship;

a plurality of rigid ink blades slidably mounted between said plates in an abutting, side-by-side, sliding relationship with each other, said blades having first and second ends, said first ends projecting beyond said forward edges of said plates and being spaced relatively close to said plates to retard the flow of ink into said assembly, said first blade ends being aligned for engagement with said roller and extending along said front edge of said assembly, said blades having arcuate faces conforming to the curvature of said roller, said blades having thicknesses slightly less than the distance between said plates allowing sliding movement of said blades between said plates;

a plurality of rotatable rods extending through said spacer bar and between said plates, each of said rods having a first end threadedly attached to a different one of said blades at said second end thereof, each of said rods further having a second end projecting beyond said spacer bar and said first edges thereby exposing said second ends along said back edge of said assembly whereby such second ends may be grasped and rotated;

means connecting said rods to said spacer bar and operative to allow said rods to be rotated relative to said spacer bar while preventing any longitudinal movement relative thereto, whereby rotation of said rods causes said blades to move linearly towards and away from said roller such that the positions of said blades are selectively adjustable relative to said roller in response to selective rotation of said rods; and, spacer means fixedly connected between said plates adjacent to said forward edges and operative to hold said plates in a rigid fixed spaced relationship along said forward edge while allowing movement of said blades between said plates means mounted adjacent said sides of said assembly for resiliently biasing said blades against each other.

2. The invention defined by claim 1 wherein:

said second ends of said blades are separated from said spacer bar to form a grease chamber between said spacer bar, said blades, and said plates.

3. The invention defined by claim 1 wherein:

each of said blades includes a hole therein extending between said plates; and, said spacer means comprises a plurality of spacer members extending through said holes and being connected to said plates.

4. The combination of claim 1 comprising:

removable connecting means detachably connecting said first plate to said assembly whereby removal of said connecting means and said first plate exposes said second plate, said rods and said blades.

5. The combination of claim 1 wherein:

said second edges of said plates are beveled and are operative to wipe said blades.

* * * * *